United States Patent [19]

Torre

[11] Patent Number: 4,683,461

[45] Date of Patent: Jul. 28, 1987

[54] INDUCTIVE MAGNETIC FIELD GENERATOR

[75] Inventor: John J. Torre, Monroe, N.Y.

[73] Assignee: Allied Corporation, Morris Township, Morris County, N.J.

[21] Appl. No.: 776,921

[22] Filed: Sep. 17, 1985

[51] Int. Cl.[4] ..... G08B 13/24

[52] U.S. Cl. ..... 340/551; 340/572

[58] Field of Search ..... 340/551, 572

[56] References Cited

U.S. PATENT DOCUMENTS

| | | | |
|---|---|---|---|
| 4,274,090 | 6/1981 | Cooper | 340/572 |
| 4,384,281 | 5/1983 | Cooper | 340/572 |
| 4,476,459 | 10/1984 | Cooper et al. | 340/572 |
| 4,510,489 | 4/1985 | Anderson, III et al. | 340/572 |
| 4,531,117 | 7/1985 | Nourse et al. | 340/572 |
| 4,565,996 | 1/1986 | Close | 340/572 |

*Primary Examiner*—Glen R. Swann, III

*Attorney, Agent, or Firm*—Ernest D. Buff; Gerhard H. Fuchs

[57] ABSTRACT

An article surveillance system includes a power line activated inductive magnetic field generator having an on duty cycle portion considerably less than 50%. A transformerless AC power line to DC converter and switching circuitry are connected to a series resonant circuit including a coil for deriving the AC inductive magnetic field. During on duty cycle portions, the switches are activated and connected to the series resonant circuit and the power supply to cause resonant current to flow in the series circuit at an activation frequency for the switches, causing the coil to generate the magnetic field at the activation frequency.

19 Claims, 7 Drawing Figures

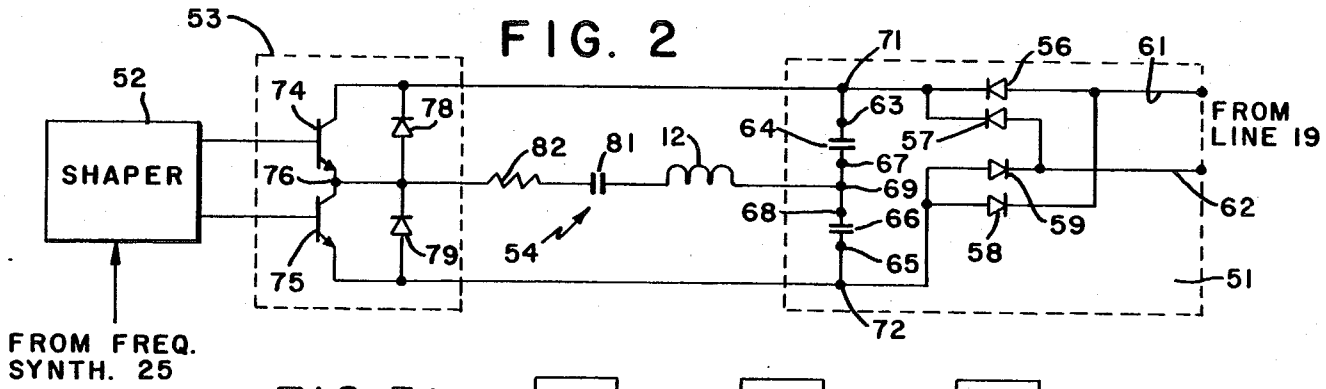
FIG. 2
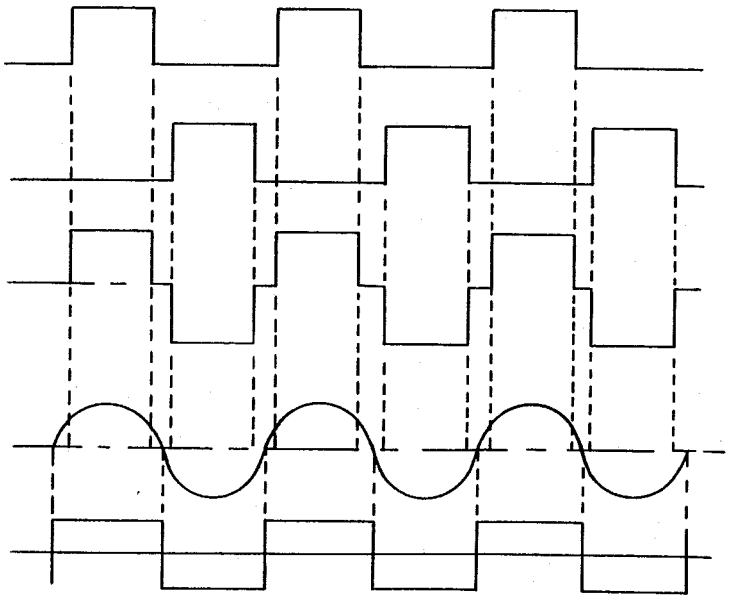
FIG. 3A
FIG. 3B
FIG. 3C
FIG. 3D
FIG. 3E

INDUCTIVE MAGNETIC FIELD GENERATOR

TECHNICAL FIELD

The present invention relates generally to AC magnetic field generators and more particularly to an AC magnetic field generator including a transformerless AC power line to DC converter, in combination with switch means and a series resonant circuit including a coil for deriving a low duty cycle AC magnetic inductive field.

BACKGROUND ART

AC magnetic inductive field generators are used for several signal applications, including article surveillance. In connection with article surveillance, the AC magnetic field derived from the generator is modified by an object resembling a tuned circuit carried on an article moved through a predetermined region of a retail establishment A receiver coil responds to the modified magnetic field to provide an indication, by activating an alarm, that such an article has been carried through the region.

It is desired for AC inductive magnetic field generators for such surveillance systems, and other systems, to be as inexpensive and efficient as possible. In the past, such magnetic field generators have included relatively expensive power supplies to enable the required AC inductive magnetic field to be derived. Typically, linear power amplifiers have been employed to obtain the desired magnetic field intensity at the required frequencies, which are typically in the 60 KHz range. However, linear amplifiers require large power transformers which increase the size, weight and cost of the AC inductive magnetic field generator.

The size and weight of generators for the required magnetic field can be reduced by utilizing switch-mode amplifiers. A basic difference between a switch-mode amplifier and a linear amplifier is that a linear amplifier continuously stores a large amount of energy, which is released as a function of an input signal. A switch-mode amplifier stores a much smaller amount of energy and releases it at a relatively high frequency. However, switch-mode amplifiers are relatively complex because they require a logic level reference frequency which activates switches of the amplifier, as well as a modulated frequency source.

It is, therefore, an object of the present invention to provide new and improved AC inductive magnetic field generator including a switch-mode device.

Another object of the invention is to provide a new and improved inductive magnetic field generator that is relatively low cost, light weight and which has a small volume so that it can easily be installed in retail establishments as part of article surveillance systems.

A further object of the invention is to provide a new and improved AC inductive magnetic field generator that is powered by a transformerless AC to DC converter and is responsive to only a single frequency determining input.

An additional object of the invention is to provide a new and improved AC inductive magnetic field generator which efficiently converts DC energy from a transformerless AC to DC converter into magnetic field energy in a package having small size, weight and cost.

DISCLOSURE OF INVENTION

In accordance with one aspect of the invention, a power line activated inductive magnetic field generator having an on duty cycle portion considerable less than 50% derives an AC magnetic field having a predetermined frequency by utilizing a transformerless AC power line to DC converter. A series resonant circuit includes coil means for deriving the field. Switch means is activated during each on duty cycle portion and is deactivated during off duty cycle portions of the magnetic field. The switch means is activated at a predetermined frequency during the on duty cycle portions and is connected to the resonant circuit, as well as to the AC to DC converter to cause resonant current to flow in the series circuit at the predetermined frequency during each on duty cycle portion so that the coil means derives the AC inductive magnetic field.

There are several advantages to this configuration. The transformerless AC power line to DC converter helps to minimize the cost, volume and weight of the generator. The switch means and resonant circuit enable the energy of the power supply to be efficiently transferred into a magnetic field. The frequency of the magnetic field is maintained constant, despite the tendency for components of the series resonant circuit to differ slightly from each other, from generator to generator, because the switch means is activated at the predetermined frequency which is required to be derived by the coil.

In the preferred embodiment, the AC power line to DC converter includes first and second terminals on which are derived opposite polarity DC voltages relative to a tap. The switch means includes first and second switch elements having a common terminal and selectively conducting paths connected in series across the first and second terminals of the converter. The series resonant circuit is connected between the tap and common terminal. The switch elements are activated during each on duty cycle portion so opposite half cycles of the resonant current alternately flow in the first and second switch elements, respectively.

Each switch element preferably includes a semiconductor device having a selectively forward biased path at the predetermined frequency, to provide a current conducting path between one terminal of the converter and the common terminal. The substantial current flows through the path in only one direction between the first named terminal and the common terminal. Diode means in shunt with the path is poled so substantial current flows in the diode means in only a second direction opposite to the direction of current flow through the semiconductor device. The paths of the semiconductor devices are forward biased during each on duty cycle portion at mutually exclusive times with a dead time during which neither of the switch elements has a forward biased semiconductor device. The dead time is sufficient to compensate for the tendency of different series circuits of different generators to have different resonant frequencies so that sinusoidal current waves having very low distortion at the predetermined frequency flow in the different resonant circuits.

In the preferred embodiment, the resonant frequency of the series resonant circuit and the activation frequency of the switch elements during each on duty cycle portion are approximately the same as the predetermined frequency. It is to be understood, however, that there could be an odd harmonic relationship between the activation frequency of the first and second switch elements and the resonant frequency of the series tuned circuit, at a slight loss of efficiency, but a possible gain in minimizing component sizes.

The AC magnetic field generator of the present invention is typically utilized in an article surveillance system for detecting objects including structures for altering the AC inductive magnetic field derived by the generator. As indicated previously, such systems include a receiver for the predetermined frequency derived by the AC inductive magnetic field generator. The receiver derives first and second different responses while an object including the structure is in and is not in a detection region magnetically coupled to the receiver and generator. The structure included on the objects or articles is responsive to the AC magnetic field derived by the generating means for coupling AC magnetic energy having a predetermined frequency to the receiver after the on duty cycle portions of the generating means have expired. The operation of the receiver is synchronized to the operation of the generator so the receiver is enabled for only a predetermined interval after the expiration of on duty cycle portions of the generating means, so that the receiver is relatively immune to magnetic field disturbances that occur during the vast majority of the off duty cycle portions.

The above and still further objects, features and advantages of the present invention will become apparent upon consideration of the following detailed description of one specific embodiment thereof, especially when taken in conjunction with the accompanying drawings.

BRIEF DESCRIPTION OF DRAWING

FIG. 2 is a circuit diagram of a transmit circuit included in FIG. 1; and FIGS. 3A–3E are waveforms useful in helping to describe the operation of FIG. 2.

BEST MODE FOR CARRYING OUT THE INVENTION

Figure 1:
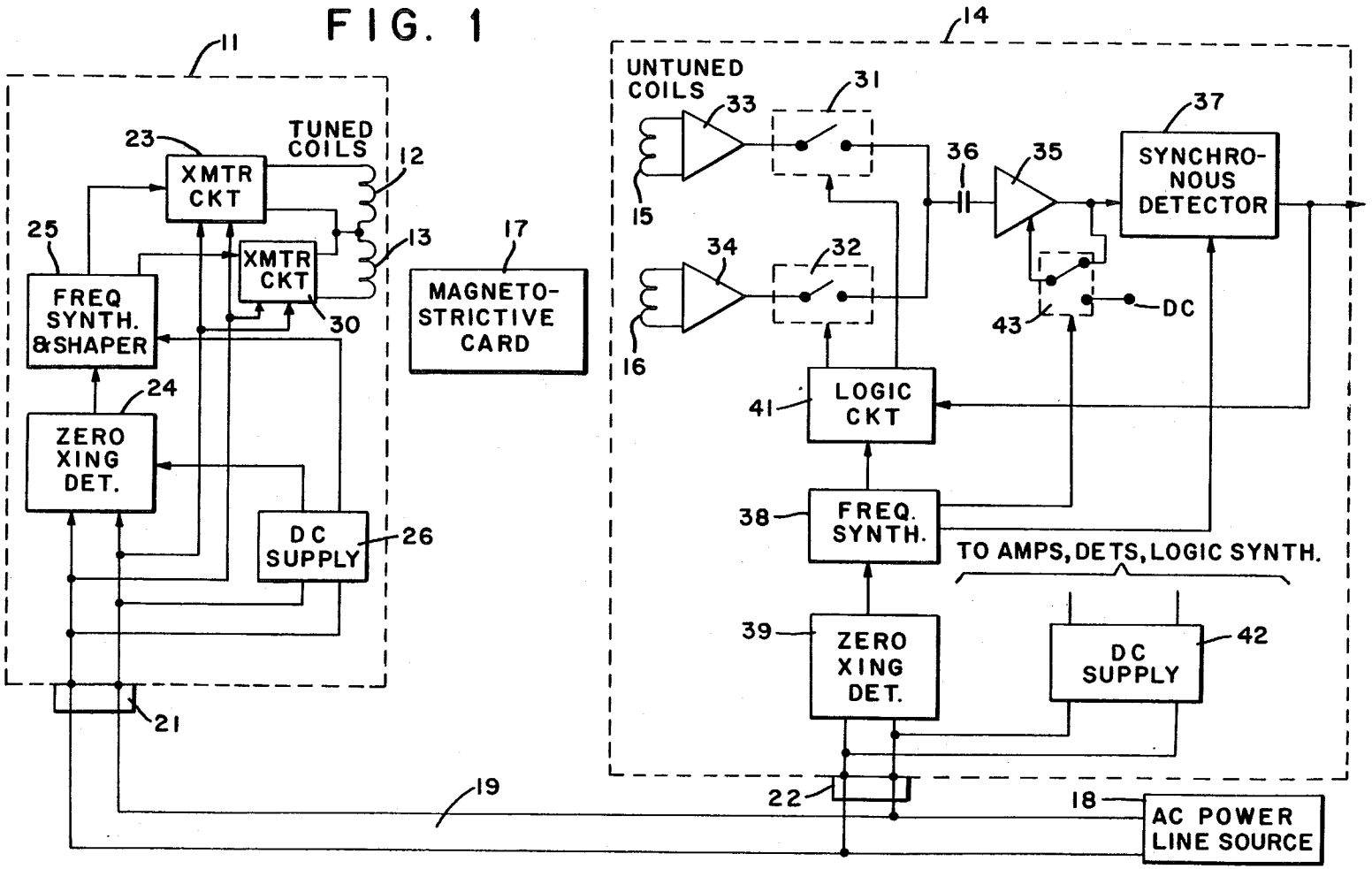
FIG. 1 is a block diagram of an article surveillance system including a magnetic field generator in accordance with the present invention.

Reference is now made to FIG. 1 of the drawing wherein there is illustrated a surveillance system incorporating the present invention. The surveillance system includes a power line activated inductive magnetic field generator or transmitter 11 having an onoff duty cycle considerably less than 50%. While generator 11 is activated into the on duty cycle portion, it derives a first AC magnetic field having a predetermined frequency, typically 60 KHz. In the preferred embodiment, the duty cycle is approximately 6.4%, achieved by having on and off duty cycle portions with durations of 1.6 and 23.4 milliseconds, respectively. The magnetic field derived by generator 11 is inductively coupled from tuned coils 12 and 13, located on one wall of a region to be monitored.

Inductive AC magnetic field power line activated receiver 14 is selectively responsive to the magnetic field derived by generator 11. Receiver 14 includes untuned magnetic field responsive coils 15 and 16, mounted on a wall opposite from the wall containing coils 12 and 13. AC magnetic field inductive coupling exists between coils 12 and 13 and at least one of coils 15 and 16 while coils 12 and 13 derive the magnetic field generated by transmitter 11. However, receiver 14 is effectively decoupled from coils 15 and 16 while coils 12 and 13 are energized. A second inductive magnetic field having a fixed predetermined carrier frequency but variable duration and amplitude is coupled to coils 15 and 16 and receiver 14 immediately after expiration of the on duty cycle portion of transmitter 11 when an article containing magnetostrictive card 17 passes in the region between the walls containing coils 12, 13 and 15, 16. The second field is detected and recognized by receiver 14 as being associated with the article passing between coils 12, 13 and 15, 16.

Card 17 is preferably manufactured in accordance with the teachings of commonly assigned U.S. Pat. No. 4,510,489, to Anderson III, et al. Typically, card 17 is carried on an article to be detected by an interaction of components in the card and the magnetic field derived from generator 11 and transduced by receiver 14. Card 17 is normally in an activated state, wherein it effectively functions as a resistance-inductance-capacitance (RLC) circuit that responds to the AC inductive magnetic field derived by generator 11. Card 17 stores the magnetic field derived from generator 11. When a pulse of the first magnetic field has terminated, the elements in magneto-strictive card 17 re-radiate the second magnetic field that is detected by receiver 14. Magnetostrictive card 17 is selectively deactivated by an appropriate operator, such as a checkout cashier, causing the AC inductive magnetic field re-radiated by the card to be undetectable by receiver 14.

Transmitter 11 and receiver 14 are synchronously activated in response to zero crossings of AC power line source 18, to enable the receiver to respond to the inductive magnetic field re-radiated from card 17 upon completion of an on duty cycle portion of transmitter 11. By synchronizing the operation of generator 11 and receiver 14 in response to zero crossings of AC power line source 18, electronic circuits included in the generator and receiver need not be electrically connected together, except by power line 19 that is connected to conventional male plugs 21 and 22 of the generator and receiver, respectively.

Generator 11 includes transmitter circuits 23 and 30 for separately and simultaneously driving tuned coils 12 and 13 with a 60 KHz carrier having a 6.4% duty cycle, such that coils 12 and 13 are supplied with sinusoidal currents at a predetermined constant frequency of 60 KHz for 1.6 milliseconds. For the next 23.4 milliseconds, coils 12 and 13 are not driven by transmitter circuits 23 and 30.

Transmitter circuits 23 and 30 are identical, with each including a transformerless AC power line to DC converter and switch means that supplies currents from opposite terminals of the AC to DC converter to coils 12 and 13 at the 60 KHz frequency, during the on duty cycle portions. To these ends, transmitter circuits 23 and 30 are directly responsive to the AC power line voltages on line 19, as coupled to generator 11 by way of male plug 21. Transmitter circuits 23 and 30 are activated into the on duty cycle portions thereof in synchronism with zero crossings of the AC voltage of power line 19, as coupled to generator 11 by way of plug 21, a result achieved by connecting zero crossing detector 24 to plug 21 so the detector derives a pulse each time the voltage on power line 19 goes through a zero value. The zero crossing indicating pulses derived by detector 24 are coupled to frequency synthesizer and shaper 25, having outputs fed to transmitter circuits 23 and 30, to cause the transmitter circuits to be activated to produce the 60 KHz bursts having the 6.4% duty cycle.

DC power is supplied to components in zero crossing detector 24 and frequency synthesizer and shaper 25 by DC supply 26, connected to line 19 by male plug 21. Supply 26 does not have the capability of providing sufficient power to derive the necessary AC inductive magnetic fields from coils 12 and 13 to be a power supply for transmitter circuits 23 and 30.

Transmitter circuits 23 and 30 are responsive to frequency synthesizer and shaper 25 so that both the transmitter circuits are simultaneously activated to simultaneously derive the same frequency during the on duty cycle portion of each activation cycle of the transmitter circuits. During alternate on duty cycle portions, transmitter circuits 23 and 30 supply in phase and out of phase currents to coils 12 and 13. Thus, during a first on duty cycle portion, the currents supplied by transmitter circuits 23 and 30 to coils 12 and 13 cause current to flow in the same direction through the coils, relative to a common terminal for the coils. During the next, i.e., second, on duty cycle portion, the currents supplied by transmitter circuits 23 and 30 to coils 12 and 13 flow in opposite directions in the coils relative to the common coil terminal.

Such a result is achieved by synthesizer 25 activating switches in transmitter circuits 23 and 30 so that the switches are activated in the same sequence, at the 60 KHz frequency, during the first duty cycle portion. During the second duty cycle portion, the switches in transmitter circuits 23 and 30 are operated in opposite manners in response to switching signals from frequency synthesizer and shaper 25 to cause the AC currents in coils 12 and 13 to have opposite relative polarities. Thus, for example, the switches of transmitter circuit 23 are always driven in the same sequence. In contrast, the switches of transmitter circuit 30 are driven during a first duty cycle portion in the same sequence as the switches of transmitter circuit 23, but during the next duty cycle portion, the activation times of the switches in transmitter circuit 30 are reversed relative to the activation times of the transmitter circuit 30 during the preceding burst.

By driving coils 12 and 13 with in phase and out of phase currents during different duty cycle portions, mutually orthogonal magnetic fields are derived from generator 11. This enables untuned coils 15 and 16 of receiver 14 to transduce the second magnetic fields of card 17, regardless of the orientation of the card relative to coils 12 and 13. The result is achieved even though coils 12, 13, 15 and 16 are all vertically disposed planar loops of wire. The loops forming coils 12 and 13 are preferably non-overlapping rectangular loops having vertically and horizontally disposed sides.

In response to coils 12 and 13 being driven by in phase currents by circuits 23 and 30 to produce in phase magnetic field flux lines, i.e., flux lines that are directed in the same direction in the centers of the loops, a horizontally directed field at right angles of the plane of the loops is produced in the vicinity of adjacent wires of the loops forming coils 12 and 13. The magnetic flux lines between the centers of the loops forming coils 12 and 13, on one side of the plane of the loops, are oppositely directed in the vertical direction on opposite sides of adjacent wires of the loops forming coils 12 and 13.

Hence, in response to the stated in phase magnetic fluxes in the loops forming coils 12 and 13, there is a relatively intense magnetic flux field to provide X axis coverage for the magnetic field responsive elements in card 17 but there is a weak vertical magnetic field due to the cancellation effect of the oppositely directed vertical fields.

A vertically directed magnetic flux field in the region between tuned transmitter coils 12 and 13 and untuned coils 15 and 16 is provided by driving the loops forming coils 12 and 13 so the magnetic fluxes generated in the centers of the loop flow in opposite directions, i.e., have an out of phase relationship. The out of phase relationship for the fluxes of loops 12 and 13 causes the lines of flux to flow in opposite directions and cancel in the vicinity of adjacent, horizontally disposed conductor segments of the loops forming coils 12 and 13. The magnetic flux lines between the centers of the loops forming coils 12 and 13, on one side of the plane of the loops, are directed in the same vertical direction to cause the coils to be effectively a single coil. The vertically directed fluxes provide Z axis coverage for the magnetic field responsive elements in card 17.

The fringing fields resulting from the in phase and out of phase activation of the loops forming coils 12 and 13 provide magnetic flux vectors in the Y axis, i.e., in horizontal planes parallel to the planes containing the loops of tuned transmitter coils 12 and 13 and untuned receiver coils 15 and 16. Thereby, magnetic flux fields in three mutually orthogonal directions are derived from the loops forming coils 12 and 13 by virtue of the in phase and out of phase drives for these coils during different on duty cycle portions of transmitter circuits 23 and 30. These mutually orthogonal magnetic flux vectors provide coupling to enabled magneto-strictive card 17, regardless of the orientation of the card relative to the plane containing planar coils 12 and 13.

When an activated magneto-strictive card 17 is in the region between tuned coils 12, 13 and untuned coils 15, 16 at least one of the untuned coils derives an electric signal that is a replica of the AC magnetic field derived from card 17. Because untuned coils 15 and 16 have different non-overlapping spatial positions relative to each other, and card 17, as well as coils 12 and 13, there is a fairly high likelihood of the electric signals transduced by coils 15 and 16 differing from each other.

Receiver 14 determines if either of coils 15 or 16 is transducing a signal having the predetermined frequency, time duration and threshold amplitude necessary to signal the presence of an activated card in the region between coils 12, 13 and coils 15, 16. The voltages generated by coils 15 and 16 are sequentially coupled to the examining or detecting circuitry of receiver 14 during activation times following each 1.6 millisecond, 60 KHz on duty cycle burst from generator 11. After a first burst one of coils 15 or 16 is coupled to the remainder of receiver 14; after the following burst the other one of coils 15 or 16 is coupled to the remainder of the receiver. In response to one of coils 15 and 16 generating a voltage having the required frequency, duration and amplitude values, the sequential coupling of the coils 15 and 16 to the remainder of receiver 14 is terminated. Coils 15 and 16 are activated in such a situation so that the coil which generated the voltage having the desired frequency, duration and amplitude is the only coil coupled to the remainder of receiver 14, until that coil is no longer receiving a burst having the required frequency, duration and amplitude characteristics. Thereafter, coils 15 and 16 are sequentially and alternately coupled immediately after different bursts from generator 11 to the remaining circuitry of receiver 14.

To these ends, the voltages transduced by untuned coils 15 and 16 are respectively coupled to normally open circuited switches 31 and 32 by way of preamplifiers 33 and 34. During normal operation when no magnetic field having the desired characteristics is coupled to either of coils 15 or 16 immediately after a burst from generator 11, one of switches 31 or 32 is closed for 25 milliseconds simultaneously with the beginning of a 1.6 millisecond burst from generator 11. Simultaneously with the next burst, the other one of switches 31 or 32 is closed for 25 milliseconds. Switches 31 and 32 have a common, normally open circuited terminal connected to an input terminal of automatic gain controlled amplifier 35 by way of series capacitor 36, which enables only AC levels coupled through switches 31 and 32 to be fed to the input of amplifier 35. The gain of amplifier 35 is preset to a predetermined level so that in response to a voltage above a threshold value being induced in one of coils 15 and 16 and coupled to the input of amplifier 35, the amplifier derives a predetermined constant amplitude output having the same frequency as the magnetic field incident on the coil. In response to the input of amplifier 35 being below a threshold level, the amplifier effectively derives a zero level.

Synchronous detector 37 responds to the AC bursts at the output of amplifier 35 which are above the threshold value to determine if these bursts have a carrier frequency equal to the frequency of the AC magnetic field derived from an activated magneto-strictive card 17. In addition, detector 37 determines the duration of bursts having the required carrier frequency. In response to a burst having the required carrier frequency and duration, synchronous detector 37 derives a binary one level which signals that an article containing an activated magneto-strictive card 17 is in the region between tuned coils 12, 13 and untuned coils 15, 16.

To control the operation of receiver 14 so that synchronous detector 37 is energized for the correct time interval associated with activated card 17 being in the region between tuned coils 12, 13 and untuned coils 15, 16 after each burst derived by generator 11, the detector is enabled by an output of frequency synthesizer 38. Synthesizer 38 responds to and is clocked by output pulses of zero crossing detector 39. The output pulses of detector 39 are synchronized with zero crossings of the AC voltage coupled by power line 19 to male plug 22. To this end, zero crossing detector 39 has an input connected to male plug 22, and an output on which a pulse is derived each time a zero crossing of the power line occurs. The pulse output of zero crossing detector 39 is applied to an input of frequency synthesizer 38.

To control the operation of switches 31 and 32 as described supra, logic circuit 41 includes first and second inputs respectively responsive to the output of synchronous detector 37 and frequency synthesizer 38. During normal operation, when synchronous detector 37 derives a binary zero output level to indicate that no activated card is between coils 12, 13 and 15, 16, logic circuit 41 responds to frequency synthesizer 38 so that immediately after first and second successive magnetic field bursts from generator 11, switches 31 and 32 are alternately activated to the closed state. In response to switch 31 being closed at the time synchronous detector 37 derives a binary one level to indicate an enabled card 17 between coils 12, 13 and 15, 16, logic circuit 41 causes switch 31 to be activated to the closed state, while maintaining switch 32 in the open state. This state of switches 31 and 32 is maintained until synchronous detector 37 again derives a binary zero level. If synchronous detector 37 derives a binary one level while switch 32 is closed, logic circuit 41 activates switches 31 and 32 so that these switches are respectively maintained in the open and closed states until a binary zero level is again derived by the synchronous detector.

Untuned coils 15 and 16 are effectively decoupled from the remainder of receiver 14 while magnetic fluxes are being derived from coils 12 and 13 because synchronous detector 37 is effectively disabled while magnetic field bursts are derived from them. Detector 37, in fact, is enabled by an output of synthesizer 30 only for a predetermined interval immediately after expiration of each on duty cycle portion of transmitter circuits 23 and 30. In addition, during the on duty cycle portions of transmitter circuits 23 and 30, frequency synthesizer 38 causes the gain of amplifier 35 to be reduced to zero, causing a zero output voltage to be coupled by the amplifier to detector 37. To this end, synthesizer 38 includes an output that is coupled as a control input to switch 43 which is normally activated to couple the output of amplifier 35 back to a gain control input of the amplifier. However, in response to the binary one output of frequency synthesizer 38 being coupled to the control input of switch 43, as occurs during the on duty cycle portions of transmitter circuits 23 and 30, switch 43 is activated to couple a negative DC voltage to a bias input of amplifier 35, to drive the amplifier gain to zero. Frequency synthesizer 38 controls synchronous detector 37 so that integrators in the detector are reset to zero during the on duty cycle portions of transmitter circuits 23 and 30.

DC operating power is supplied to amplifiers 33–35, synchronous detector 37, frequency synthesizer 38, zero crossing detector 39 and logic circuit 41 by DC power supply 42, connected to power line 19 by way of male plug 22.

Details of the configurations of tuned coils 12 and 13 and untuned coils 15 and 16 are described in copending, commonly assigned application of John J. Torre et al, filed concurrently herewith, and bearing the title, "System Including Tuned AC Magnetic Field Transmit Antenna and Untuned AC Magnetic Field Receive Antenna", Serial No. 777,059. Details of synchronous detector 37 are described in U.S. Pat. No. 4,644,296 issued Feb. 17, 1987. Details of logic circuit 41 are described in copending, commonly assigned application of John J. Torre entitled, "Selector For AC Magnetic Inductive Field Receiver Coils", filed concurrently herewith, Serial No. 777,057.

Reference is now made to FIG. 2, a circuit diagram of the circuitry included in transmitter circuits 23 and 30. Because the circuitry in circuits 23 and 30 is identical, the description of FIG. 2 for transmitter circuit 23 suffices for both of circuits 23 and 30.

Transmitter circuit 23 includes a transformerless AC power line to DC power supply 51, shaping circuit 52 responsive to an output of frequency synthesizer and shaper 25, switch means 53, and resonant circuit 54 that includes coil 12. Shaper 52 responds to the output of frequency synthesizer and shaper 25 to supply switch means 53 with out of phase control signals. Switch means 53 is energized by opposite polarity voltages from transformerless power supply 51 to cause a low duty cycle current to flow in series resonant circuit 54 at the frequency supplied to the switch means by shaper 52.

Transformerless AC power line to DC supply 51 includes full wave bridge rectifier 55, consisting of diodes 56–59, connected directly to power line leads 61 and 62. Diodes 56 and 57 include anodes respectively connected to leads 61 and 62, while diodes 58 and 59 include cathodes respectively connected to leads 61 and 62. Diodes 56 and 57 include cathodes having a common connection to electrode 63 of energy storing filter capacitor 64, while diodes 58 and 59 include anodes having a common connection to a negatively biased electrode 65 of capacitor 66. Electrodes 67 and 68 of capacitors 64 and 66 have a common connection at tap 69 of power supply 51. Positive and negative DC voltages are respectively derived at output terminals 71 and 72 of power supply 51, respectively connected to electrodes 63 and 65.

Switch means 53 includes NPN bi-polar transistors 74 and 75, respectively having bases driven by out of phase control voltages from shaper 52. Transistors 74 and 75 include collector emitter paths that are forward biased in response to the voltages supplied to the bases thereof by shaper 52 and which are supplied with positive and negative voltages by terminals 71 and 72 of power supply 51. The collectors and emitters of transistors 74 and 75 are respectively connected to terminals 71 and 72, while the emitter of transistor 74 and the collector of transistor 75 have a common terminal 76. The emitter collector paths of transistor 74 and 75 are respectively shunted by diodes 78 and 79, poled so that current flows in them in a direction opposite from the direction of current flow in the respective shunted collector emitter path.

Tap 69 and common terminal 76 are connected to opposite terminals of series resonant circuit 54, including inductive magnetic field transmitting coil 12, tuning capacitor 81 and resistor 82. The value of capacitor 81 is selected so that circuit 54 is resonant to approximately the same frequency as the switching frequency of transistors 74 and 75 during the on duty cycle portions. However, because of deviations in the values of the inductance of coil 12 and the capacitance of capacitor 81, the resonant frequency of circuit 54 is rarely, if ever, exactly equal to the activation frequency of transistors 74 and 75 during the on duty cycle portion. Resistor 82, which controls the Q of the resonant circuit, helps to assure that sinusoidal currents having very low distortion flow in circuit 54 despite the slight deviations in the resonant frequency of circuit 54 in different generator units relative to the drive frequency of switches 74 and 75 during the on duty cycle portion.

In operation, there is a slight dead time between the end of a forward bias interval for the collector emitter path of transistor switch 74 and the initiation of a forward bias for the collector emitter path of transistor 75 during each 60 KHz cycle of the drive provided for the bases of transistors 74 and 75, and vice versa for forward bias transitions from transistor 75 to transistor 74. The dead time is provided by shaper 52 responding to a 60 KHz input from synthesizer 25, to supply the bases of transistors 74 and 75 with control signals having the complementary waveforms illustrated in FIGS. 3A and 3B.

Transistors 74 and 75 are respectively forward biased during the positive portions of the waves illustrated in FIGS. 3A and 3B. At all other times, transistors 74 and 75 are back biased. While transistor 74 is forward biased, current flows from electrode 63 of capacitor 64 through terminals 71 and the collector emitter path of transistor 74 to common terminal 76, thence through series resonant circuit 54 to tap 69 and back to the negative electrode of capacitor 64. In response to the collector emitter path of transistor 75 being forward biased, current flows from positive electrode 68 of capacitor 66 through tap 69 to series resonant circuit 54 and the collector emitter path of transistor 75 back to electrode 65 of capacitor 66 by way of terminal 72. Thus, current flows in opposite directions through series resonant circuit 54 during the complementary conduction intervals of transistors 74 and 75.

Because of the low duty cycle forward biasing of transistors 74 and 75, there is a relatively low current drain from capacitors 64 and 66 during each on duty cycle portion. This low duty cycle enables the inexpensive transformerless AC to DC converter 51 to be employed. The maximum duty cycle for activating switching transistors 74 and 75 is determined by several factors, such as the response characteristics of magnetostrictive card 17, synchronous detector 37 of receiver 14, and the circuitry and components of AC to DC converter 51.

Diodes 78 and 79 combine with resistor 82 to enable virtually distortion free sinusoidal current to flow in coil 12, even though the resonant frequency of circuit 54 differs slightly from the drive frequency for the bases of transistors 74 and 75. Because of the energy storage characteristics of coil 12 and capacitor 81, there is a tendency for current to continue to flow in resonant circuit 54 after back biasing of transistors 74 and 75. The dead time between the beginning of back biasing of one of these transistors and the forward biasing of the other transistor enables diodes 78 and 79 shunting the transistor emitter collector paths to absorb the current which has a tendency to continue to flow in resonant circuit 54.

When transistors 74 and 75 are driven with the signals illustrated in FIGS. 3A and 3B, the voltage between tap 69 and common terminal 76 has the waveform illustrated in FIG. 3C. This waveform consists of positive and negative levels respectively equal to the voltages at terminals 71 and 72. Between the positive and negative levels of the waveform of FIG. 3C subsist zero voltage levels coincident with the dead times of transistors 74 and 75.

In response to the voltage between tap 69 and terminal 76 impressed across resonant circuit 54 with resonant frequency equal to the activation frequency of transistors 74 and 75, a current having the waveshape illustrated in FIG. 3D flows in the resonant circuit 54.

The resulting voltage between tap 69 and terminal 76 is illustrated in FIG. 3E and results from the continuous current flow thru the resonant circuit 54 during the dead time of transistors 74 and 75, VIA the conduction paths supplied by diodes 78 and 79.

Thus even though there exists a dead time in the drive signals to transistors 74 and 75, the resultant output voltage across the resonant circuit 54 is without deadtime by virtue of the alternate conduction thru diodes 78 and 79 of the current thru the resonant circuit 54. Typically, a positive current having a near zero value flows in circuit 54 from terminal 76 towards tap 69 at the time transistor 74 is initially back biased. This current flows through tap 69 into electrode 68 of capacitor 66, through the capacitor and back to common terminal 76 by way of diode 79. When the current in resonant circuit 54 changes polarity during the dead time interval, positive current flows from resonant circuit 54 to terminal 76 and diode 78 to electrode 63 of capacitor 64.

When the collector emitter path of transistor 75 is forward biased, the current flowing from series resonant 54 continues to flow to terminal 76, but now flows through the low impedance collector emitter path of transistor 75 through capacitor 66 to tap 69. While transistor 75 is forward biased, current drains from capacitor 66 into the load provided by series resonant circuit 54 and transistor 75. Thus, while transistor 75 is forward biased, current flows from tap 69 to terminal 76 through series resonant circuit 54 in a direction opposite from the direction of current flow through the series resonant circuit while transistor 74 is forward biased. When transistor 75 is cut off, the current flowing in resonant circuit 54 through terminal 76 is shifted so that it flows through diode 78 to assist in recharging capacitor 64. Such current flow continues during the dead time until there is a reversal in the direction of current flow in resonant circuit 54, at which time capacitor 66 is supplied with charging current by way of the path completed through diode 79.

During the off duty cycle portion, as subsists for more than 90% of the time with the specified on and off duty cycle durations of 1.6 and 23.4 milliseconds, respectively, the rectified DC voltage supplied to terminals 71 and 72 by diode bridge rectifier 75 causes capacitors 64 and 66 to be recharged.

The value of resistor 82 is selected so that the Q of tuned resonant circuit 54 is at least equal to eight to assist in providing the desired low distortion sinusoidal current. The peak amplitude of the sinusoidal current flowing in resonant circuit 54 is determined to a large extent by the resistance of resistor 82, and is approximately equal to the peak amplitude of the output voltage of inverter 51, between terminals 71 and 72, divided by the resistance of resistor 82.

The frequency of current flowing in series resonant 54 is determined by the 60 KHz operating frequency of transistors 74 and 75, even if there is a deviation in the resonant frequency of circuit 54 from the operating frequency of the transistors. In such a situation, diodes 78 and 79 conduct the leading and lagging currents which respectively flow in resonant circuit 54 in response to the activation of frequency of transistors 74 and 75 being respectively less than and greater than the resonant frequency circuit 54.

Because of the switch-mode operation of transmitter circuit 23, wherein transistors 74 and 75 are operated in fully on and fully off modes, the power dissipation level of the circuit is much lower than prior art devices. The switch-mode operation of transmitter 11 with the resonant load provided by circuit 54 reduces stresses and switching losses of transistors 74 and 75, to increase reliability and efficiency of the device.

While there has been described and illustrated one specific embodiment of the invention, it will be clear that variations in the details of the embodiment specifically illustrated and described may be made without departing from the true spirit and scope of the invention as defined in the appended claims.

I claim:

1. A power-line-activated inductive magnetic field generator having an on-duty cycle portion considerably less than 50% for deriving an AC magnetic field having a predetermined frequency comprising: a transformerless AC-power-line-to-DC converter, a series resonant circuit including coil means, and switch means activated during the on-duty cycle portions and deactivated during off-duty cycle portions, the switch means being activated at a selected frequency during the on-duty cycle portions and being connected to the resonant circuit as well as to the converter to cause resonant current to flow in the series circuit at the predetermined frequency during each on-duty cycle portion to thereby cause the coil means to derive the AC inductive magnetic field.

2. The generator of claim 1 wherein the converter includes first and second terminals on which are derived opposite polarity DC voltages relative to a tap, the switch means including first and second switch elements having a common terminal and selectively conducting paths connected in series across the first and second terminals, the series resonant circuit being connected between the tap and the common terminal, the switch elements being activated during each on-duty cycle portion so opposite half cycles of the resonant current alternately flow through said switch elements and said switch elements have complimentary conduction intervals.

3. The generator of claim 2 wherein the resonant frequency of the series resonant circuit and the activation frequency of the first and second switch elements during each on duty cycle portion are approximately the same as the predetermined frequency.

4. The generator of claim 3 wherein each switch element includes a semiconductor device having a conductive path which is selectively forward biased at the predetermined frequency connected between one terminal of the converter and the common terminal, substantial current flowing through said path in only one direction between said one terminal and the common terminal, and diode means in shunt with said path poled so substantial current flows in said diode means in only a second direction opposite to said one direction between said one terminal and the common terminal.

5. The generator of claim 4 wherein the paths of said semiconductor devices of the first and second switch elements are forward biased during each on-duty cycle portion at mutually exclusive times with a dead time during neither of the switch elements has a forward biased semiconductor device, the dead time being sufficient to compensate for the tendency of different series circuits of different generators to have different resonant frequencies so that sinusoidal current waves having very low distortion at the predetermined frequency flow in the different resonant circuits.

6. The generator of claim 2 wherein each switch element includes a semiconductor device having a conducting path which is selectively forward biased at the predetermined frequency connected between one terminal of the converter and the common terminal, substantial current flowing through said path in only one direction between said one terminal and the common terminal, and diode means in shunt with said path poled so substantial current flows in said diode means in only a second direction opposite to said one direction between said one terminal and the common terminal.

7. The generator of claim 6 wherein the paths of said semiconductor devices of the first and second switch elements are forward biased during each on-duty cycle portion at mutually exclusive times with a dead time during which neither of the switch elements has a forward biased semiconductor device, the dead time being sufficient to compensate for the tendency of different series circuits of different generators to have different resonant frequencies so that sinusoidal current waves having very low distortion at the

8. The generator of claim 1 wherein the resonant frequency of the series resonant circuit and the activation frequency of the first and second switch elements during each on duty cycle portion are approximately the same as the predetermined frequency.

9. The generator of claim 1 wherein the switch means includes first and second switch elements having a common terminal and selectively conducting paths connected in series across the first and second terminals, the switch elements being activated during each on-duty cycle portion and being connected to the resonant circuit and to the converter so opposite half cycles of the resonant current alternatively flow through said switch elements and said switch elements have complimentary conduction intervals.

10. The generator of claim 9 wherein each switch element includes a semiconductor device having a conductive path which is selectively forward biased at the predetermined frequency connected between one terminal of the converter and the common terminal, substantial current flowing through said path in only one direction between said one terminal and the common terminal, and diode means in shunt with said path poled so substantial current flows in said diode means in only a second direction opposite to said diode means in only a second direction opposite to said one direction between said one terminal and the common terminal.

11. The generator of claim 10 wherein the paths of said semiconductor devices of the first and second switch elements are forward biased during each on-duty cycle portion at mutually exclusive times with a dead time during which neither of the switch elements has a forward biased semiconductor device, the dead time being sufficient to compensate for the tendency of different series circuits of different generators to have different resonant frequencies so that sinusoidal current waves having very low distortion at the predetermined frequency flow in the different resonant circuits.

12. A system for detecting objects including structures for altering an AC inductive magnetic field comprising a means for generating a first inductive magnetic field having an on-duty cycle portion considerably less than 50%, the generating means deriving the first magnetic field at a predetermined AC frequency during the on-duty cycle portions, the structure responding to the predetermined frequency of the first magnetic field to derive a second inductive magnetic field at a predetermined frequency, a receiver for the predetermined frequency of the second inductive magnetic field, the receiver deriving first and second different responses while an object including the structure is in and is not in a detection region magnetically coupled to the receiver and the transmitter, the generating means including: a transformerless AC-power-line-to-DC converter, a series resonant circuit including coil means, and switch means activated during the on-duty cycle portions and deactivated during the off-duty cycle portions, the switch means being activated at a selected frequency during the on-duty cycle portions and being connected to the resonant circuit as well as to the converter to cause resonant current to flow in the series circuit at the predetermined frequency during each on-duty cycle portion to thereby cause the coil means to derive the AC inductive magnetic field.

13. The system of claim 12 wherein each structure is responsive to the AC magnetic field derived by the generating means for coupling to the receiver after on-duty cycle portions of the generating means have expired, and further including means for synchronizing the operation of the receiver to the generating means so the receiver is effectively enabled for only a predetermined interval after the expiration of on-duty cycle portions of the generating means.

14. The system of claim 12 wherein the converter includes first and second terminals on which are derived opposite polarity DC voltages relative to a tap, the switch means including first and second switch elements having a common terminal and selectively conducting paths connected in series across the first and second terminals, the series resonant circuit being connected between the tap and the common terminal, the switch elements being activated during each on-duty cycle portion so opposite half cycles of the resonant current alternatly flow through said switch elements and said switch elements have complimentary conduction intervals.

15. The system of claim 14 wherein the resonant frequency of the series resonant circuit and the activation frequency of the first and second switch elements during each on duty cycle portion are approximately the same as the predetermined frequency.

16. The system of claim 15 wherein each switch element includes a semiconductor device having a conductive path which is selectively forward biased at the predetermined frequency connected between one terminal of the converter and the common terminal, substantial current flowing through said path in only one direction between said one terminal and the common terminal, and diode means in shunt with said path poled so substantial current flows in said diode means in only a second direction opposite to said one direction between said one terminal and the common terminal.

17. The system of claim 16 wherein the paths of said semiconductor devices of the first and second switch elements are forward biased during each on-duty cycle portion at mutually exclusive times with a dead time during which neither of the switch elements has a forward biased semiconductor device, the dead time being sufficient to compensate for the tendency of different series circuits of different generators to have different resonant frequencies so that sinusoidal current waves having very low distortion at the predetermined frequency flow in the different resonant circuits.

18. The system of claim 14 wherein each switch element includes a semiconductor device having a conductive path which is selectively forward biased at the predetermined frequency connected between one terminal of the converter and the common terminal, substantial current flowing through said path in only one direction between said one terminal and the common terminal, and diode means in shunt with said path poled so substantial current flows in said diode means in only a second direction opposite to said one direction between said one terminal and the common terminal.

19. The system of claim 18 wherein the paths of said semiconductor devices of the first and second switch elements are forward biased during each on-duty cycle portion at mutually exclusive times with a dead time during which neither of the switch elements has a forward biased semiconductor device, the dead time being sufficient to compensate for the tendency of different series circuits of different generators to have different resonant frequencies so that sinusoidal current waves having very low distortion at the predetermined frequency flow in the different resonant circuits.

* * * * *